US006525471B2

(12) United States Patent
Bachmann et al.

(10) Patent No.: US 6,525,471 B2
(45) Date of Patent: Feb. 25, 2003

(54) PLASMA PICTURE SCREEN WITH PROTECTIVE LAYER

(75) Inventors: Peter Klaus Bachmann, Wuerselen (DE); Volker Van Elsbergen, Aachen (DE); Markus Klein, Freiburg (DE); Rob Snijkers, Landgraaf (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/853,099

(22) Filed: May 10, 2001

(65) Prior Publication Data

US 2002/0003407 A1 Jan. 10, 2002

(30) Foreign Application Priority Data

May 12, 2000 (DE) ..... 100 23 341

(51) Int. Cl.[7] ..... H01J 17/49

(52) U.S. Cl. ..... 313/587; 313/582; 313/489

(58) Field of Search ..... 313/587, 586, 313/582, 489

(56) References Cited

U.S. PATENT DOCUMENTS 4,603,082 A * 7/1986 Zelez ..... 428/336
5,703,437 A * 12/1997 Komaki ..... 313/587
5,705,886 A * 1/1998 Bongaerts et al. ..... 313/483
6,229,582 B1 * 5/2001 Van Slooten ..... 313/582

FOREIGN PATENT DOCUMENTS

JP 1154048 2/1999 ..... H01J/11/02

* cited by examiner

*Primary Examiner*—Vip Patel
*Assistant Examiner*—Joseph Williams

(57) ABSTRACT

The invention relates to a plasma picture screen with a protective layer (5) made of materials having a low electron affinity and a high resistance to sputtering.

4 Claims, 1 Drawing Sheet

PLASMA PICTURE SCREEN WITH PROTECTIVE LAYER

FIELD OF THE INVENTION

The invention relates to a plasma picture screen provided with a front plate comprising a glass plate on which a dielectric layer and a protective layer are provided, with a carrier plate provided with a phosphor layer, with a ribbed structure which subdivides the space between the front plate and the carrier plate into plasma cells, which are filled with a gas, and with one or several electrode arrays on the front plate and the carrier plate for generating corona discharges in the plasma cells.

BACKGROUND AND SUMMARY OF THE INVENTION

Plasma picture screens render possible color pictures with high resolution, large screen diameter, and have a compact construction. A plasma picture screen comprises a hermetically closed glass cell which is filled with a gas, with electrodes in a grid arrangement. The application of a voltage causes a gas discharge which generates mainly light in the vacuum ultraviolet range. This VUV light is converted into visible light by phosphors and is emitted through the front plate of the glass cell to the viewer.

Plasma picture screens are subdivided into two classes: DC plasma picture screens and AC plasma picture screens. The electrodes in DC plasma picture screens are in direct contact with the plasma. In AC plasma picture screens, the electrodes are separated from the plasma by a dielectric layer.

In principle, two types of AC plasma picture screens can be distinguished: with a matrix arrangement and with a coplanar arrangement of the electrode arrays. In the matrix arrangement, the gas discharge is ignited and maintained at the intersection of two electrodes on the front and on the carrier plate. In the coplanar arrangement, the gas discharge is maintained between the electrodes on the front plate and is ignited at the point of intersection with an electrode, a so-called address electrode, on the carrier plate. The address electrode in this case lies below the phosphor layer.

The dielectric layer in a typical AC plasma picture screen is covered by an additional MgO layer. MgO has a high ion-induced secondary electron emission coefficient and thus reduces the ignition voltage of the gas. In addition, MgO is resistant to sputtering by positively charged ions of the plasma. A disadvantage is, however, that MgO is readily contaminated by foreign substances during the manufacturing process, which substances are very difficult to remove afterwards.

JP 11054048 A of Patent Abstracts of Japan discloses an AC plasma picture screen which has a protective layer of diamond-resembling carbon (amorphous diamond) on the dielectric layer instead of a protective layer of MgO. The protective layer has an amorphous structure and is deposited in a CVD (Chemical Vapor Deposition) process.

A disadvantage of the use of diamond-like carbon in the protective layer is that diamond-like carbon may change its structure and may partly also evolve hydrogen under the rigid conditions, for example high temperatures, prevailing in the manufacture of plasma picture screens. A disadvantage of the structure change is that a layer with a graphite content is formed thereby, which shows a brownish discoloration. This reduces the luminance of the plasma picture screen. Evolved hydrogen may change the gas phase inside the plasma picture screen, so that, for example, the ignition voltage may change in an uncontrolled manner.

The invention has for its object to provide an improved plasma picture screen.

This object is achieved by means of a plasma picture screen provided with a front plate comprising a glass plate on which a dielectric layer and a protective layer are provided, with a carrier plate provided with a phosphor layer, with a ribbed structure which subdivides the space between the front plate and the carrier plate into plasma cells, which are filled with a gas, and with one or several electrode arrays on the front plate and the carrier plate for generating corona discharges in the plasma cells, wherein the protective layer comprises a material chosen from the group of crystalline diamond, AlN, AlGaN, BN, and tetrahedral amorphous carbon.

These materials have a high chemical resistance, for example to high temperatures in the manufacture of the plasma picture screen, and compared with MgO they are not hygroscopic. They also show a higher physical resistance than diamond-resembling carbon and are, for example, sputter resistant to high-energy plasma ingredients. In addition, a protective layer made of one of these materials contains no appreciable quantities of hydrogen, and a change in the gas phase in the discharge cells through the generation of hydrogen is prevented.

It is furthermore preferred that the gas comprises xenon in a relative quantity of more than 7% by volume.

A protective layer of crystalline diamond, AlN, AlGaN, BN, or tetrahedral amorphous carbon renders it possible to increase the xenon quantity in the gas without a major rise in the ignition temperature. The increase in the proportional quantity of UV light generating xenon in the gas renders the UV radiation generation, and thus the excitation of the phosphors more efficient.

BRIEF DESCRIPTION OF THE DRAWING

The invention will now be explained in more detail below with reference to a Figure and to embodiments, with FIG. 1 showing the construction and operating principle of a single plasma cell in an AC plasma picture screen.

DETAILED DESCRIPTION

Figure 1:
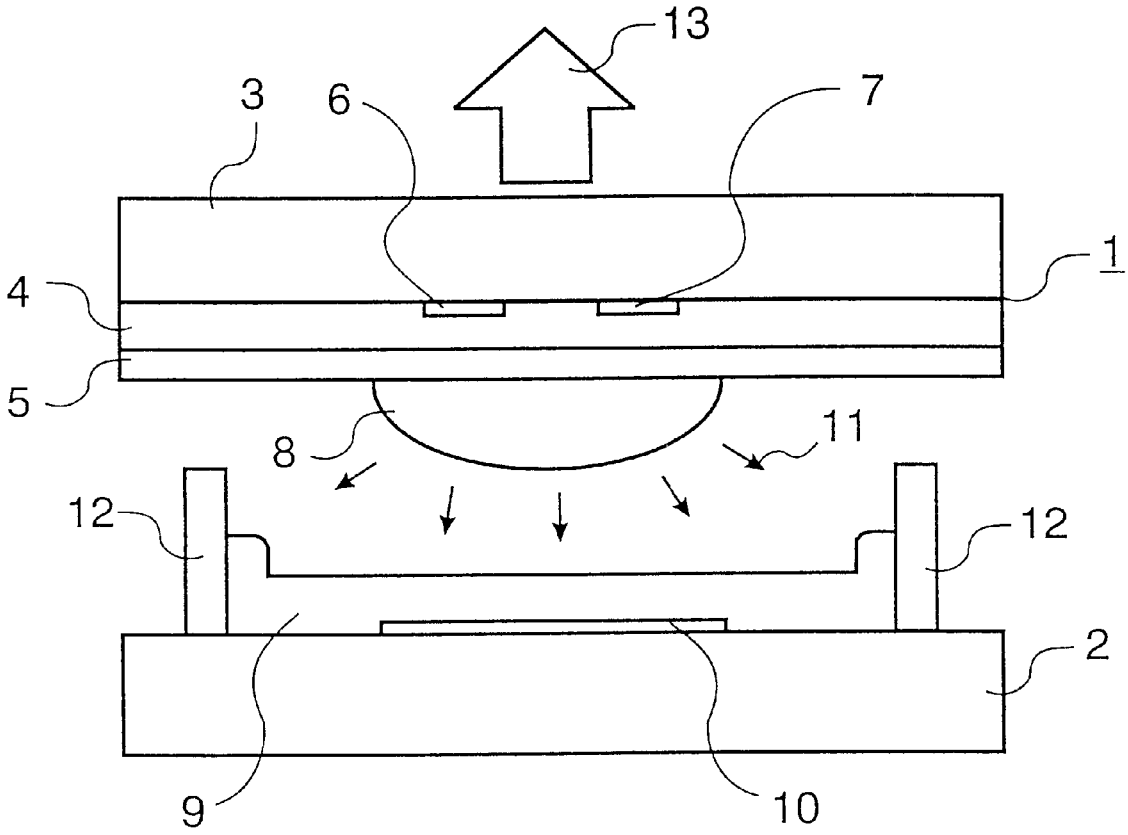

In FIG. 1, a plasma cell of an AC plasma picture screen with a coplanar electrode arrangement comprises a front plate 1 and a carrier plate 2. The front plate I comprises a glass plate 3 on which a dielectric layer 4 and thereon a protective layer 5 are provided. The dielectric layer 4 is made, for example, of glass containing PbO. Parallel, strip-shaped discharge electrodes 6, 7 are provided on the glass plate 3 and are covered by the dielectric layer 4. The discharge electrodes 6, 7 are made, for example, of metal or ITO. The carrier plate 2 is made of glass, and parallel, strip-shaped address electrodes 10, for example made of Ag, are provided on the carrier plate 2 so as to run perpendicularly to the discharge electrodes 6, 7. Said address electrodes 10 are covered by respective phosphor layers 9 which emit each in one of the three basic colors red, green, blue. The individual plasma cells are separated by a ribbed structure 12 with separation ribs which are preferably made of a dielectric material.

A gas, preferably a rare gas mixture comprising, for example, He, Ne, or Kr, containing Xe as a UV light generating component, is present in the plasma cell, i.e. between the discharge electrodes 6, 7 which alternate as the cathode and anode. After the surface discharge has been ignited, whereby charges can flow along a discharge path lying between the discharge electrodes 6, 7 in the plasma region 8, a plasma is formed in the plasma region 8 which generates radiation 11 in the UV range, in particular in the VUV range, depending on the composition of the gas. This radiation 11 excites the phosphor layer 9 into phosphorescence, thus emitting visible light 13 in one of the three basic colors, which light issues to the exterior through the front plate 1 and thus forms a luminous pixel on the picture screen. The blue-emitting phosphor used in the phosphor layer 9 may be, for example, $BaMgAl_{10}O_{17}$:Eu, the green-emitting phosphor $Zn_2SiO_4$:Mn, and the red-emitting phosphor (Y,Gd)$BO_3$:Eu.

The dielectric layer 4 lying over the transparent discharge electrodes 6, 7 in an AC plasma picture screen serves inter alia to counteract a direct discharge between the discharge electrodes 6, 7 of conductive material, and thus the formation of an arc in the ignition of the discharge.

To manufacture a front plate 1 with a protective layer 4, the discharge electrodes 6, 7 are first provided on a glass plate 3, whose dimensions correspond to the desired picture screen format, in a vapor deposition process and a subsequent structuring step. Then the dielectric layer 4 is provided and dried.

The manufacture of a protective layer 5 may take place by various methods, which are known per se, in dependence on the material. A protective layer 5 comprising crystalline diamond may be manufactured by CVD methods. For this purpose, a gas mixture usually comprising carbon and hydrogen as well as, possibly, oxygen, rare gases, or halogens, is broken up into reactive radicals and molecule portions from which a diamond film is deposited on a hot substrate. The excitation of the gas mixture may be achieved, for example, by means of a plasma, a hot wire, an arc discharge, or a chemical flame such as, for example, an acetylene-oxygen flame.

A protective layer 5 comprising AlN may be provided by reactive sputtering on an Al target in an atmosphere comprising nitrogen. A protective layer 5 comprising AlN or AlGaN may be manufactured by MO (Metal Organic)-CVD or plasma CVD. Suitable metal-organic compounds are excited and converted here either thermally or by means of a plasma in the presence of a nitrogen source.

Similarly, a protective layer 5 comprising BN may be manufactured by CVD or reactive sputtering. In this case, suitable organic boron compounds are used. In addition, BN-containing layers may be made by ion ray supported deposition techniques. The BN may have a cubic or hexagonal crystal lattice.

A protective layer 5 comprising tetrahedral amorphous carbon (t-a:C) may be manufactured, for example, in a filtered arc discharge from graphite, or alternatively by CVD techniques.

The layer thickness of the protective layer 5 preferably lies between 2 nm and 10 $\mu$m. Particularly strongly preferred are layer thicknesses between 5 nm and 1 $\mu$m.

The entire front plate 1 is given an aftertreatment at 100 to 600° C. for two hours and is used for the assembly of an AC plasma picture screen together with a glass carrier plate 2 which has a ribbed structure 12, conductive address electrodes 10, and a phosphor layer 9. The gas preferably comprises a rare gas mixture such as Ne/Xe, He/Xe, or Ne/He/Xe, wherein the proportional quantity of xenon in the gas preferably is at least 7% by volume. The gas may alternatively be pure xenon. The higher the proportion of xenon generating the UV light, the higher the efficiency of the UV radiation generation and thus of the excitation of the phosphors.

The protective layer 5, which comprises a material of low electron affinity, reduces the ignition and operating voltages of the plasma. The effect that the ignition voltage of the plasma rises with a rising xenon content can be partly compensated thereby, and an inexpensive electronic driver unit can be used in the plasma picture screen. The plasma picture screen then not only has a more resistant protective layer 5, but also an enhanced luminance.

Embodiments of the invention will be explained in detail below, representing examples of how the invention may be carried into practice.

Embodiment 1

A diamond film was provided as the protective layer 5 on the dielectric layer 4 of a front plate 1, comprising a glass plate 3, a dielectric layer 4, and two discharge electrodes 6, 7, by means of microwave plasma CVD. The dielectric layer 4 comprised PbO, and the two discharge electrodes 6, 7 were made of ITO. The layer thickness of the protective layer 5 of crystalline diamond was 0.5 $\mu$m.

The entire front plate 1 was given an aftertreatment at 200 to 400° C. for two hours and was subsequently used for assembling an AC plasma picture screen together with a glass carrier plate 2, which comprised a ribbed structure 12, address electrodes 10 of Ag, and a phosphor layer 9, as well as a gas mixture with a composition of 7% Xe and 93% Ne by volume, which screen showed an enhanced luminance.

Embodiment 2

A layer of AlN was provided as the protective layer 5 on the dielectric layer 4 of a front plate 1, comprising a glass plate 3, a dielectric layer 4, and two discharge electrodes 6, 7, by means of microwave plasma CVD with a pure nitrogen plasma and trimethyl aluminum. The dielectric layer 4 comprised PbO, and the two discharge electrodes 6, 7 were made of ITO. The layer thickness of the protective layer 5 was 0.3 $\mu$m.

The entire front plate 1 was given an aftertreatment at 200 to 400° C. for two hours and was subsequently used for assembling a plasma picture screen together with a glass carrier plate 2, comprising a ribbed structure 12, address electrodes 10 of Ag, and a phosphor layer 9, as well as a gas mixture having a composition of 20% Xe and 80% Ne by volume, which screen showed an enhanced luminance.

What is claimed is:

1. A plasma picture screen provided with a front plate (1) comprising a glass plate (3) on which a dielectric layer (4) and a protective layer (5) are provided, with a carrier plate (2) provided with a phosphor layer (9), with a ribbed structure (12) which subdivides the space between the front plate (1) and the carrier plate (2) into plasma cells, which are filled with a gas, and with one or several electrode arrays (6, 7, 10) on the front plate (1) and the carrier plate (2) for generating corona discharges in the plasma cells, characterized in that the protective layer (5) comprises a material chosen from the group of crystalline diamond, AlN, AlGaN, BN, and tetrahedral amorphous carbon.

2. A plasma picture screen as claimed in claim 1, characterized in that the gas comprises xenon in a relative quantity of more than 7% by volume.

3. A plasma picture screen provided with a front plate comprising:

a glass plate on which a dielectric layer and a protective layer are provided;

a carrier plate provided with a phosphor layer;

a ribbed structure that subdivides the space between the front plate and the carrier plate into plasma cells, which are filled with a gas; and at least one electrode array on at least one of the front plate and the carrier plate for generating corona discharges in the plasma cells, wherein the protective layer completely covers the at least one electrode array, and comprises a material chosen from the group of crystalline diamond, AlN, AlGaN, BN, and tetrahedral amorphous carbon.

4. The plasma picture screen of claim 3, wherein the gas comprises xenon in a relative quantity of more than 7% by volume.

* * * * *